US007506524B2

(12) United States Patent
Gustin

(10) Patent No.: US 7,506,524 B2
(45) Date of Patent: Mar. 24, 2009

(54) HAND KNITTING LOOM AND METHOD OF USE

(75) Inventor: Clella Gustin, Spanish Fork, UT (US)

(73) Assignee: Provo Craft and Novelty, Inc., Spanish Fork, UT (US)

( * ) Notice: Subject to any disclaimer, the term of this patent is extended or adjusted under 35 U.S.C. 154(b) by 0 days.

(21) Appl. No.: 11/963,229

(22) Filed: Dec. 21, 2007

(65) Prior Publication Data

US 2008/0156043 A1 Jul. 3, 2008

Related U.S. Application Data

(60) Provisional application No. 60/877,587, filed on Dec. 28, 2006.

(51) Int. Cl.
*D04B 3/00* (2006.01)

(52) U.S. Cl. ..... 66/1 A

(58) Field of Classification Search ..... 66/3, 66/4, 1 R; 139/29, 34; 28/16.5, 17
See application file for complete search history.

(56) References Cited

U.S. PATENT DOCUMENTS 1,500,383 A * 7/1924 Gourie ..... 66/4
1,694,849 A * 12/1928 Fujii ..... 66/4
1,705,860 A * 3/1929 Hagihara ..... 66/4
1,776,561 A * 9/1930 La Croix ..... 66/4
2,072,668 A * 3/1937 Eltgroth ..... 66/4
2,237,733 A * 4/1941 Grimm et al. ..... 66/4
2,270,619 A * 1/1942 Bowyer ..... 66/4
2,318,018 A * 5/1943 Semonsen ..... 66/4
3,678,709 A * 7/1972 Nowicki et al. ..... 66/4
3,967,467 A * 7/1976 Leach, Sr. ..... 66/4
4,158,296 A * 6/1979 Dunlop ..... 66/4
4,248,063 A * 2/1981 Wang ..... 66/4
4,393,668 A * 7/1983 Leach, Sr. ..... 66/4
4,729,229 A * 3/1988 Whicker ..... 66/4
5,231,742 A 8/1993 Macbain
5,413,150 A * 5/1995 Townsend ..... 139/34

OTHER PUBLICATIONS

Int'l Search report from PCT/US2007/088629.

* cited by examiner

*Primary Examiner*—Danny Worrell
(74) *Attorney, Agent, or Firm*—Honigman Miller Schwartz and Cohn LLP

(57) ABSTRACT

A loom includes a plurality of knitting pegs. The loom further includes a substantially non-circular base structure configured to hold the plurality of knitting pegs substantially perpendicular to the plane of the substantially non-circular base structure. The substantially non-circular base structure also includes an elongated orifice having a long axis and a short axis. The plurality of knitting pegs form two substantially parallel rows of knitting pegs separated by the short axis of the elongated orifice. The loom also includes at least one knitting peg near the apex of the long axis of the elongated orifice and between the two substantially parallel rows of knitting pegs.

22 Claims, 5 Drawing Sheets

HAND KNITTING LOOM AND METHOD OF USE

CROSS-REFERENCE TO RELATED APPLICATION

The present application claims priority to and hereby incorporates by reference U.S. Provisional Patent Application Ser. No. 60/877,587 filed on Dec. 28, 2006.

TECHNICAL FIELD

This invention relates to a knitting loom and a method of using a knitting loom.

BACKGROUND

Weaving may utilize any number of different kinds of looms, ranging from simple hand held structures to complex machines. Looms commonly used today for non-commercial knitting include handlooms that may be rectangular, circular or oblong and have projecting pegs configured to hold the warp loops and the woven weft loops. An example of a rectangular loom includes the Knifty Knitter™ rectangle loom available from PROVO CRAFT®.

At least one advantage of handlooms is the ease of use and the ability of the user to utilize techniques that are more sophisticated as their skill with the loom increases. However, each type of handloom (e.g., circular, rectangular, oblong) does not provide for multiple uses. For example, a circular handloom is useful for circular knitting. However, the circular handloom does not provide for double knitting of straight pieces and may be difficult to use for single knit.

Therefore, users desiring to knit different styles of knits (e.g., single, double, circular knits) are required to purchase and carry both a circular handloom and a rectangular or elliptical loom. Moreover, the looms take up significant space and may be difficult to use in cramped quarters such as a car or an airplane.

Thus, there is a need for a handloom that is capable of producing single, double, and circular knits. Moreover, it is desirable to provide a loom having a reduced size that may make transporting and using the loom in a restricted space, e.g., a car or airplane, easier.

BRIEF DESCRIPTION OF THE DRAWINGS

The features and inventive aspects will become more apparent upon reading the following detailed description, claims, and drawings, of which the following is a brief description:

DETAILED DESCRIPTION

Figure 1:
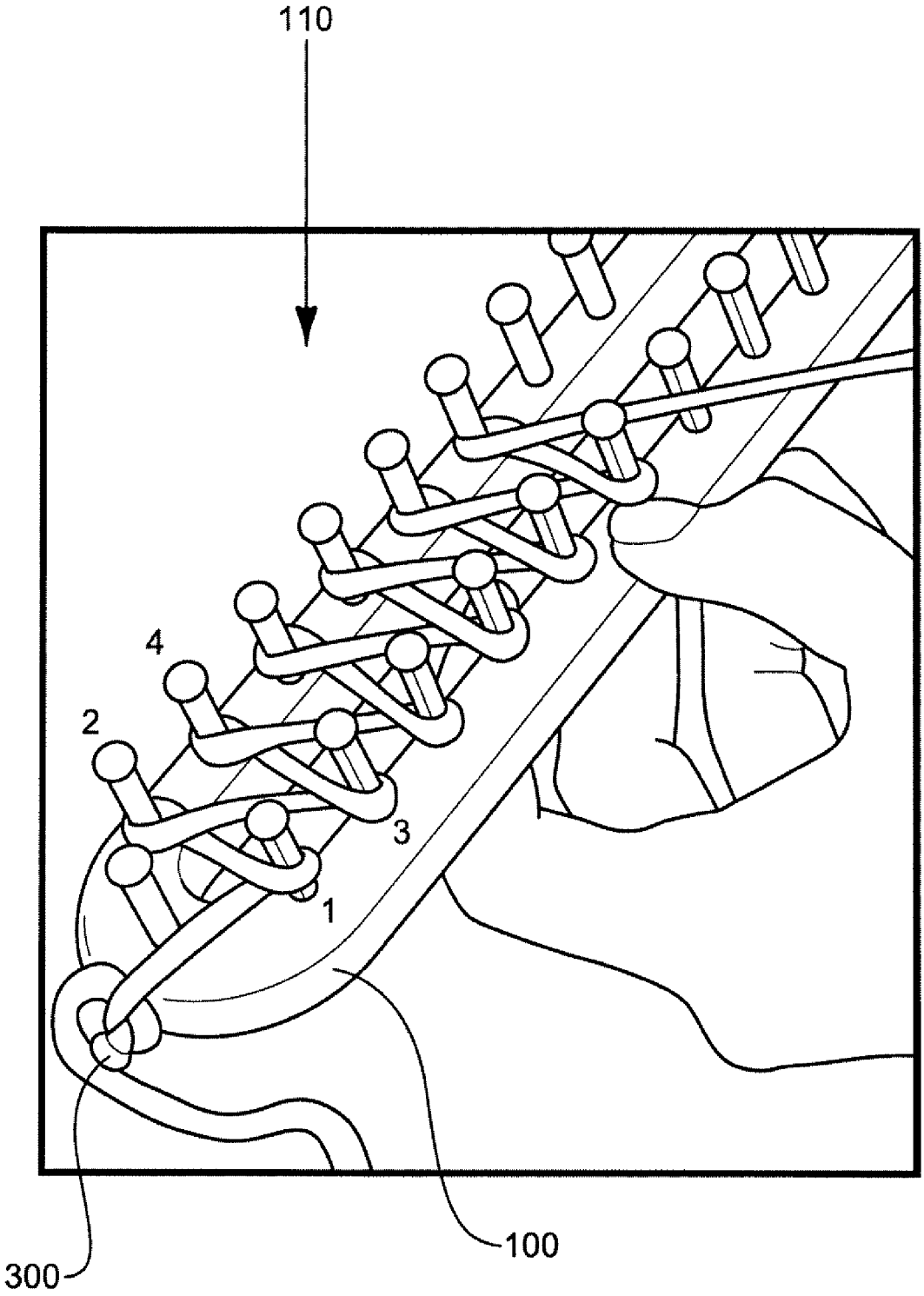
FIG. 1 is a perspective view of an example where the loom is a rounded rectangle.

Referring now to the drawings, illustrative embodiments are shown in detail. Although the drawings represent the embodiments, the drawings are not necessarily to scale and certain features may be exaggerated to better illustrate and explain novel aspects of an embodiment. Further, the embodiments described herein are not intended to be exhaustive or otherwise limit or restrict the claims to the precise form and configuration shown in the drawings and disclosed in the following detailed description.

The examples discussed herein provide that a single handloom may perform single knit, double knit and circular knit. These looms are typically narrow and compact. They may be shaped, but not exclusively, as oblong, elliptical, and/or rectangular. The looms discussed herein may also be associated with a method of knitting that may include producing a closed circular knitting using a non-circular knitting loom.

The examples discussed herein relate to a non-circular knitting loom. The loom includes a plurality of knitting pegs spaced generally equidistant relative to one another around the perimeter of the loom. The loom may provide for at least one knitting peg at one or more ends of the loom. Alternatively, the knitting peg may be located at the apex of the rectangle, ellipse, oval, rounded rectangle and/or oblong between two substantially parallel rows of knitting pegs.

In general, examples of the looms discussed herein may include a non-circular knitting loom having an orifice between two substantially parallel rows of knitting pegs and at least one knitting peg at an end of the loom between the two substantially parallel rows of knitting pegs. In another example, the plurality of knitting pegs may be spaced equidistant relative to one another around the loom. The loom may be configured as, but not limited to, having a rectangular, elliptical, oblong, oval, or rounded rectangle shape. The loom may also have a knitting peg at one or more ends between the two substantially parallel rows of knitting pegs.

As used herein, "yarn" means any conventional flexible material suitable for weaving, such as commercially available twines and yarn. Also, as used herein, "substantially equidistant" means that any two adjacent knitting pegs are spaced apart by a substantially equal distance. "Substantially equidistant" also refers to the position of a knitting peg at one or more ends of the base structure relative to either of the two substantially parallel rows of knitting pegs, wherein the deviation from equal distance is less than twice the spacing of any two adjacent knitting pegs.

The substantially non-circular base structure of the loom may include, but is not limited to, the following shapes: an ellipse, an oblong, a rectangle, a rounded rectangle or an oval. In addition, the substantially non-circular base structure of the invention includes an orifice having a long axis and a short axis.

In an example, the knitting pegs are detachably connected to the loom. For example, the knitting pegs may be generally cylindrical in shape, having a top end and a bottom end, wherein the bottom end is configured to connect to a hole in the base structure. Optionally, the knitting pegs may have a groove or channel starting at or near the top end of the knitting peg and running to the bottom end or near the bottom end of the knitting peg.

In another example, with reference to FIG. 1, a knitting loom 110 is shown having a substantially non-circular base structure 100 having a top, a bottom, an inside and an outside surface defining an orifice within the base structure 100 and having a plurality of knitting pegs (1 to 17) connected to a top surface of the base structure 100, wherein the plurality of knitting pegs form two substantially parallel rows (pegs 2, 4, 6, 8, 10, 12, 14, and 16, illustrating a first row, and pegs 1, 3, 5, 7, 9, 11, 13, 15, and 17 illustrating the second parallel row) substantially perpendicular to the plane of the base structure 100. Preferably, the knitting pegs are spaced substantially equidistant from one another. Preferably, the base structure 100 includes at least one yarn attachment point, e.g., an end peg 300 (e.g., a yarn attachment point), located on at least one end of the base structure 100, where the yarn attachment point 300 is useful for holding the yarn in place when initiating knitting.

Figure 2A:
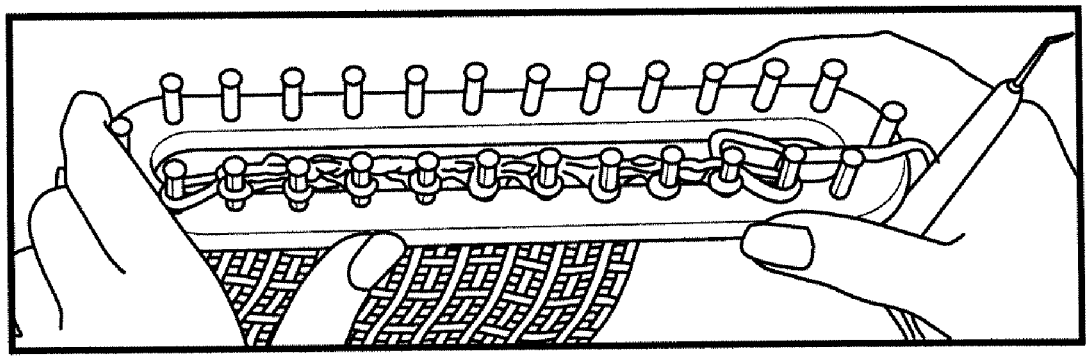
FIG. 2A shows a single knit for use with the loom of FIG. 1.
Figure 2B:
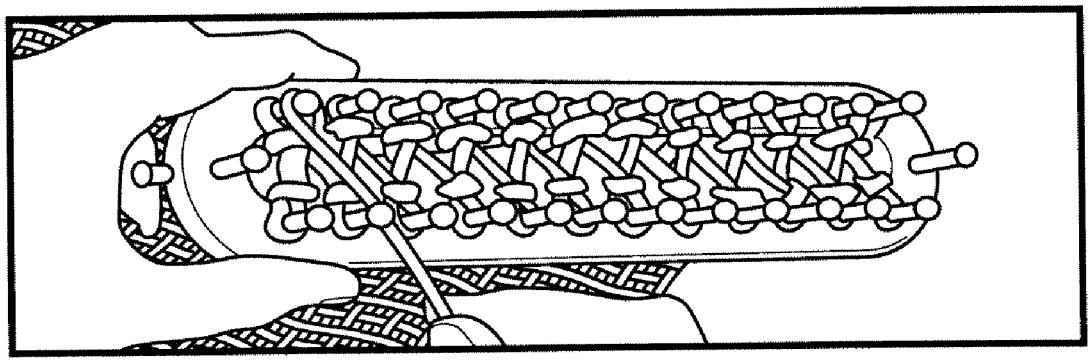
FIG. 2B shows a double knit for use with the loom of FIG. 1.
Figure 2C:
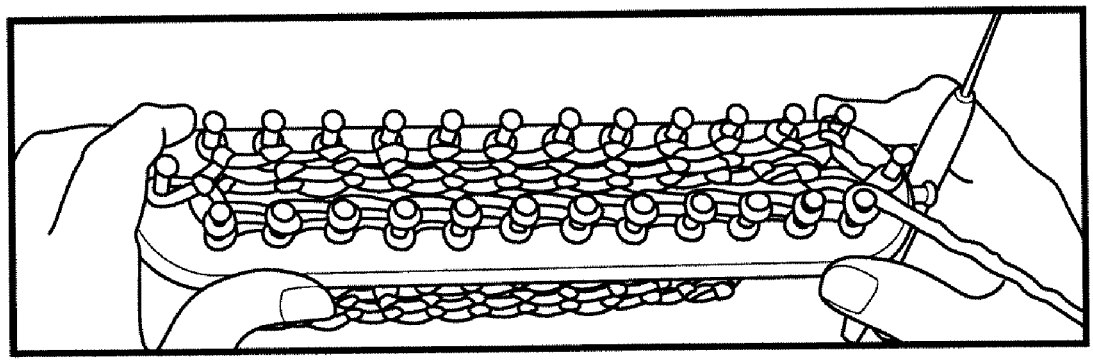
FIG. 2C shows a circular knit for use with the loom of FIG. 1.

A typical rectangular or elliptical handloom is useful for knitting straight pieces using a single knit (FIG. 2A) or a double knit (FIG. 2B), but lacks the ability to knit tubes (FIG. 2C). In contrast, circular handlooms are useful for circular knitting, but do not allow double knitting of straight pieces and may be difficult to use for single knit. Therefore, a user wishing to knit single, double and circular knits was required to purchase and carry both a circular handloom and a rectangular or elliptical loom. In contrast, the present invention provides a handloom that is capable of producing all three knits (single, double, and circular knit). In addition to providing a single knitting loom capable of use with single, double and circular knit, the present invention provides a significant size reduction relative to circular looms that makes transporting and using the loom in a restricted space, e.g., a car or airplane, easier.

Figure 3:
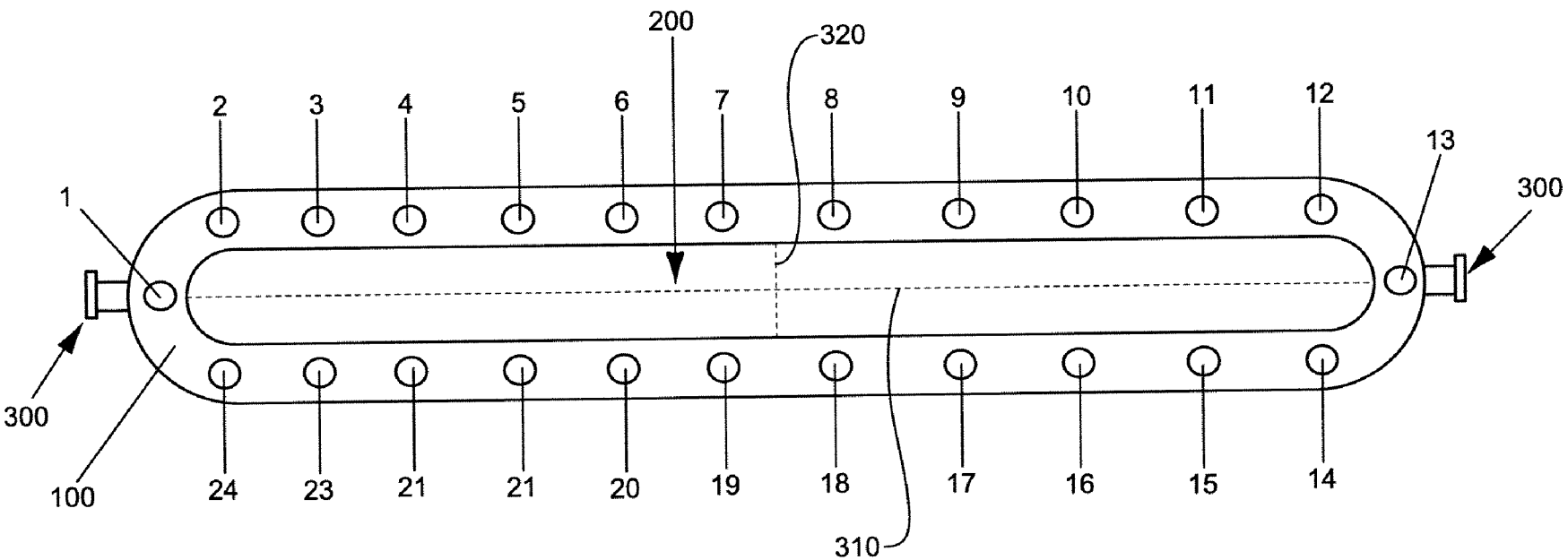
FIG. 3 is a top plane view of an example of the loom.

Referring to the example illustrated in FIG. 3, the non-circular base structure 100 is a rounded rectangle, having an orifice 200 with a long axis 310 and a short axis 320. It is configured with a plurality of knitting pegs 1 to 24 spaced substantially equidistant from one another and substantially perpendicular to the base structure 100. Knitting pegs 1 and 13 may be positioned at the apex of long axis 310 of orifice 200 between parallel rows of knitting pegs 2-12 and 14-24. In addition, the base structure 100 includes at least one attachment point 300 located substantially parallel to the plane of the base at each end of the non-circular base structure. End peg 300 is typically used for holding the yarn in place when initiating knitting.

Pegs 1-18 may be made as part of base structure 100 or they may be made separately or any variation thereof. If any of pegs 1-18 are made separately from base structure 100, they may be received by base structure 100 by holes. The holes are then configured to receive the peg and hold it tightly in place. In any event, any of pegs 1-18 may be held by base structure 100 permanently or removably.

Figure 4:
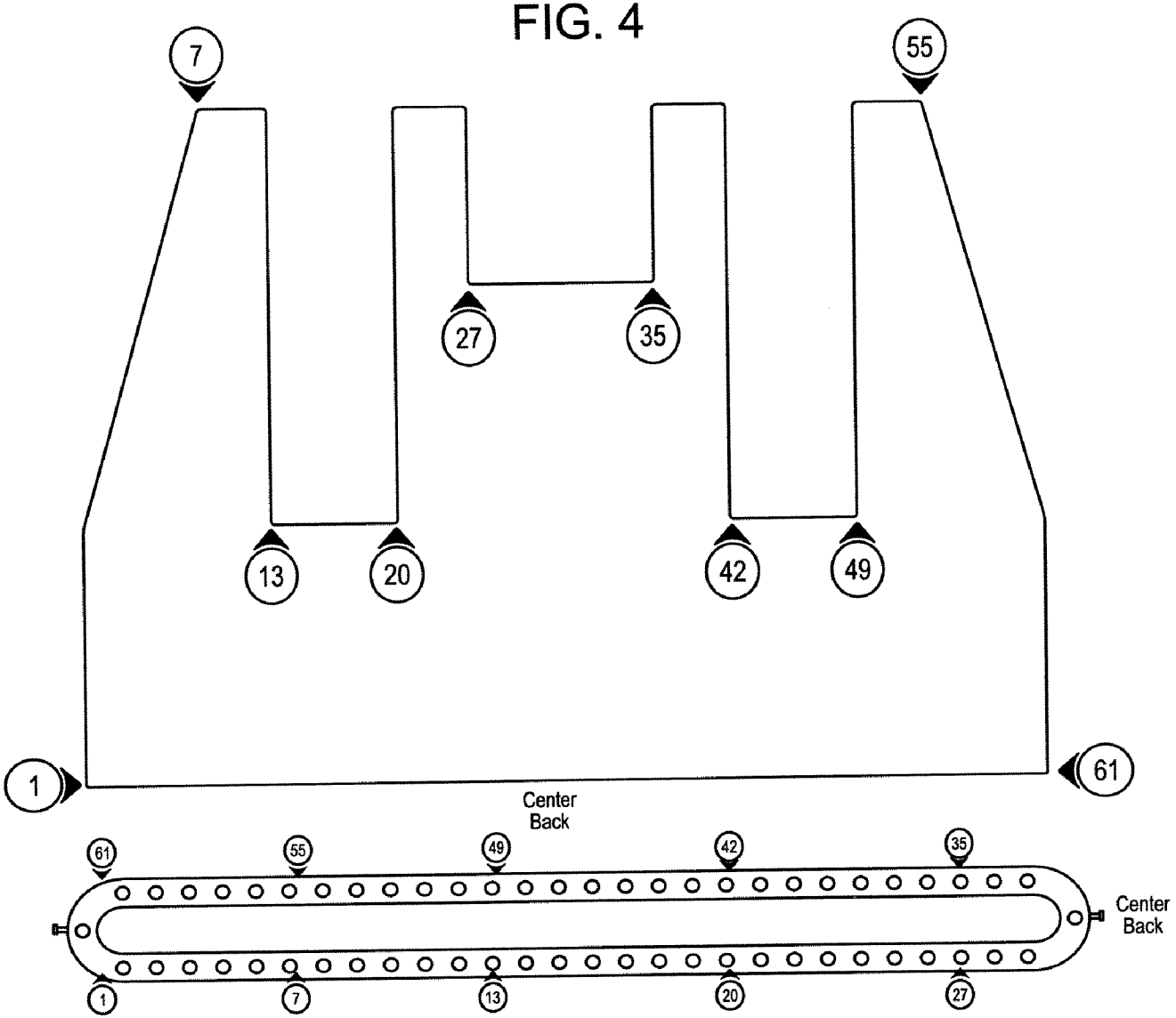
FIG. 4 shows an example of peg numbering for knitting a vest.

Referring to FIG. 4, a user may weave a vest by initially tying pieces of yarn around knitting pegs 13, 20, 27, 35, 42, and 49, as an example of a method of knitting an item (e.g., a circular item) using a rectangular or elliptical handloom as described herein. In this example, pegs 13 and 20 correspond to the left armhole. Knitting pegs 41 and 49 correspond to the right armhole. Knitting pegs 27 and 36 represent the initiation of the neck hole. Starting on peg 1, the user wraps the loom with yarn without utilizing peg 62. The user then knits for approximately seven inches (approximately 27 rows) using knitting pegs 1 to 61. On the 28th row of weaving, the user should be knitting from the right to the left. Knit to peg 49, which has the marker yarn attached to it. Wrap the next eight knitting pegs very loosely. Take the loops from knitting pegs 49 and 48, and pull the loop from peg 48 through the loop from peg 49. Then take the loop from peg 47 through the loop from peg 48. Continue in this manner until the user has decreased the stitches between the markers, including the loops on the marked knitting pegs (knitting pegs 49 and 42). Knit across the back part of the vest to the marker on peg 20 and decrease the stitches between the markers on peg 20 and peg 13. Knit to the end of the row. Any remaining yarn may remain attached and be used for the left front of the vest. Next, the user may attach another piece of yarn as a marker on peg 20, and knit the back section until the user has knit approximately nine and a half inches, or approximately 38 rows. Knit six stitches to the marker on knitting peg 36 and decrease the stitches between knitting pegs 35 and 27 (they have markers on them). Knit the left side until the user has knitted approximately four inches. Take the weaving off the loom. Attach a piece of yarn as a marker on peg 35 and knit approximately four inches, or approximately sixteen rows. Take the knitting off the loom. Using the attached yarn, knit approximately eight inches. Start decreasing on the front side of the vest, one stitch every inch, or every four rows; repeat six times. Take the knitting from the loom and attach yarn as a marker on peg 49 and knit approximately eight inches. Starting on the front side of the vest, decrease one stitch every inch, or every four rows; repeat six times. Sew the shoulder seams together. The user may add some fringe pieces where desirable.

Figure 5A:
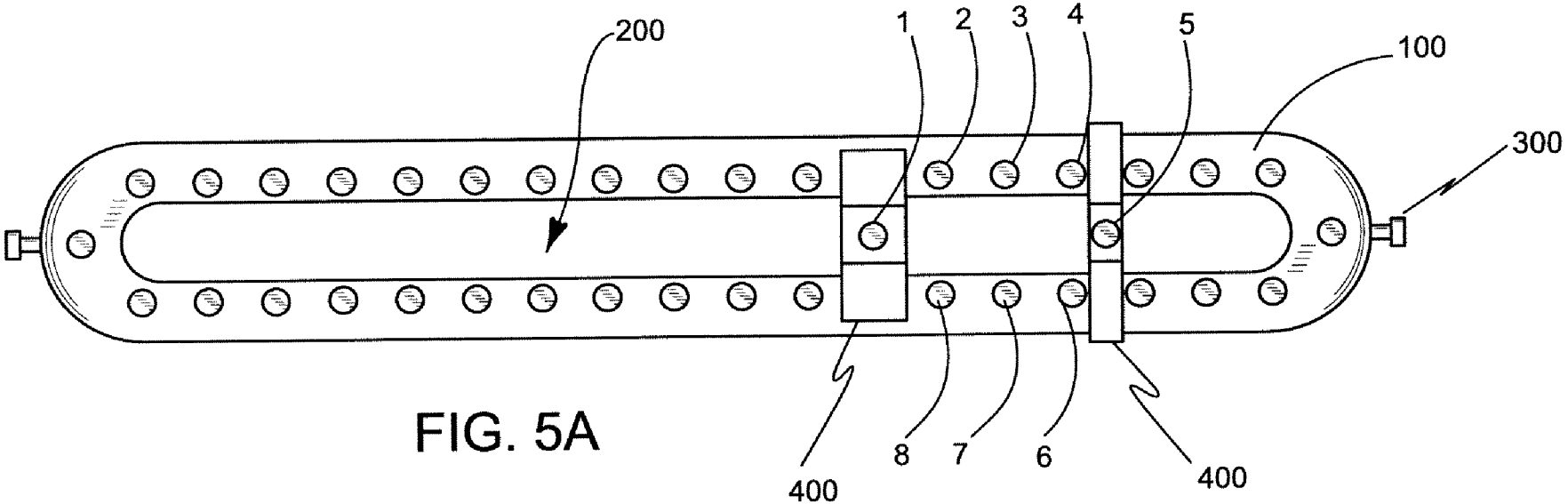
FIG. 5A is a top plane view of a knitting loom that includes two examples of a movable bridge.
Figure 5B:
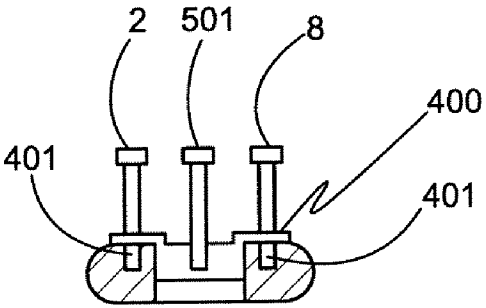
FIG. 5B is a partial cross-sectional side view of the knitting loom and a first embodiment of the moveable bridge.
Figure 5C:
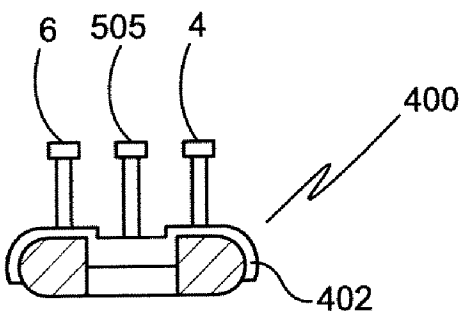
FIG. 5C is a partial cross-sectional side view of the knitting loom and a second embodiment of the moveable bridge.

Referring to FIG. 5, one or more knitting pegs may be located between the substantially parallel rows of knitting pegs by means of a cross-bridge 400 configured to connect to base structure 100. For example, at least one knitting peg at the apex of long axis 310 (see FIG. 3) of the orifice 200 may be positioned within the orifice 200 (see FIGS. 3 and 5A) by any suitable means. Such means may include cross-bridge 400 configured to attach to the base structure 100 by way of replacing at least one detachable knitting peg with cross-bridge 400 having appendages 401 (e.g., pins) adapted to connect to the base structure 100, as illustrated in FIG. 5B corresponding to cross-bridge 400 on the left of FIG. 5A. Alternatively, the example shown in FIG. 5C illustrates a cross-bridge 400 adapted to clasp, or be clasped by, the base structure as shown by the cross bridge on the right of FIG. 5A. These examples allow the user to carry a single knitting loom and one or more cross-bridges 400. Cross-bridges 400 may be configured to produce a circular knit having a diameter smaller than the effective diameter of the knitting loom.

Cross-bridges 400 may connect to base structure 100 in a number of ways including clip attachments (such as wings 402) or appendages 401 (e.g., pins) that interfere with receiving holes in base structure 100. Moreover, the clip attachments may also be precisely aligned (e.g., located) with base structure 100 using pins protruding from the under side of each clip attachment. Such alignment provides proper substantially equidistant spacing for movable pin 501 between pins 2 and 8 and matches the pin spacing between, e.g., pins 8 and 7. Similarly, movable pin 505 is spaced equidistant between pins 4 and 6 and matches the pin spacing between, e.g., pins 6 and 7.

Alternatively, mounting may use the width of cross-bridges 400 to be configured to fit snugly between pins (on the same side) so that the alignment is provided. Alternative examples may include pins that are attached to only one side of base structure 100. For example, pin 501 may be attached in an L-shape manner to only one side, received by a hole in base structure 100. However, cross-bridges 400 provide additional stability for pins 501, 505 by virtue of providing support on both sides of base structure 100.

As will be recognized by a person of ordinary skill in the art, the base structure may be of any desirable size and may contain any number of knitting pegs spaced equidistant around the base structure. In addition, the looms of the invention may be made of any suitable material, such as wood, plastic, rubber, or metal.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. The embodiments should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

With regard to the processes, methods, heuristics, etc. described herein, it should be understood that although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes described herein are provided for illustrating certain embodiments and should in no way be construed to limit the claimed invention.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

What is claimed is:

1. A loom comprising:

a plurality of knitting pegs; and a substantially non-circular base structure connected to said plurality of knitting pegs, wherein the plurality of knitting pegs are arranged substantially perpendicular to said substantially non-circular base structure, wherein said substantially non-circular base structure comprises an elongated orifice having a long axis and a short axis, wherein said plurality of knitting pegs are arranged to form two substantially parallel rows of knitting pegs that are substantially perpendicular to said short axis of said elongated orifice;

at least one knitting peg of the plurality of knitting pegs defining one or more intermediate pegs and being aligned along the long axis of said elongated orifice and arranged between said two substantially parallel rows of knitting pegs; and at least one end peg arranged on the substantially non-circular base structure, wherein the at least one end peg arranged substantially perpendicularly to the plurality of knitting pegs and the at the one or more intermediate pegs.

2. The loom of claim 1, wherein said at least one end peg is arranged near the one or more intermediate pegs.

3. The loom of claim 1, wherein said substantially non-circular base structure is an oval.

4. The loom of claim 1, wherein said substantially non-circular base structure is a rounded rectangle.

5. The loom of claim 1, wherein the at least one end peg defines means for attaching yarn to said non-circular base structure.

6. The loom of claim 1, wherein said plurality of knitting pegs are detachably connected to said substantially non-circular base structure.

7. The loom of claim 1, wherein said plurality of knitting pegs and intermediate pegs are spaced substantially equidistant relative to one another.

8. A loom comprising:

an elongate base having two beams, said two beams connected at their first ends by a first connecting member, said two beams connected at their second ends by a second connecting member, whereby the connection of the two beams by the first and second connecting members form an elongate orifice;

a plurality of pegs extending from said each of said two beams;

at least one peg extending from one or more of the first and second connecting members, said at least one peg being spaced substantially equidistant to the nearest of said plurality of pegs extending from each of said two beams; and at least one end peg extending front one of said first connecting member and said second connecting members, wherein the at least one end peg is arranged substantially perpendicularly to the plurality of pegs and the at least one peg.

9. The loom of claim 8, wherein said plurality of pegs and at least one peg are spaced substantially equidistant relative to one another.

10. The loom of claim 8, wherein said elongate base is configured as substantially oval.

11. The loom of claim 8, wherein said elongate base is configured as a rounded rectangle.

12. The loom of claim 8, wherein said plurality of pegs are detachable.

13. The loom of claim 8, wherein said plurality of pegs are unitary with said elongate base.

14. The loom of claim 8, wherein said two beams are detachable.

15. The loom of claim 8, wherein the at least one end peg defines means for attaching yarn to said elongate base.

16. A method of knitting a tube shaped knit material, the method comprising:

providing a substantially non-circular loom having two beams that are connected at their first ends by a first connecting member, said two beams connected at their second ends by a second connecting member, whereby the connection of the two beams by the first and second connecting members form an elongate orifice;

providing a plurality of pegs upon the substantially non-circular loom by arranging a plurality of knitting pegs around the elongated orifice, and arranging at least one end peg substantially perpendicularly the plurality of pegs;

utilizing the substantially non-circular loom for attaching a first end of a length of material to the at least one end peg, and wrapping the material about said plurality of knitting pegs for forming a tube shaped body from the length of material.

17. The method of claim 16, further comprising defining the elongate orifice to include a long axis and a short axis, wherein said plurality of knitting pegs define two substantially parallel rows of knitting pegs that are substantially perpendicular to said short axis of said elongated orifice, wherein said plurality of knitting pegs further define one or more intermediate pegs that is/are aligned with the long axis of said elongated orifice and arranged between said two substantially parallel rows of knitting pegs.

18. The method of claim 17, comprising providing a substantially non-circular loom having a rounded rectangle shape.

19. The method of claim 17, wherein said rounded rectangle shape has one knitting peg at each apex of said long axis of the elongated orifice.

20. The loom of claim 1 further comprising a cross-bridge structure including a central portion flanked by a first lateral portion and a second lateral portion;

wherein the first lateral portion is removably-connected to a first elongated base member of the substantially non-circular base structure;

wherein the second lateral portion is removably-connected to a second elongated base member of the substantially non-circular base structure; and wherein the central portion includes at least one second intermediate peg that is aligned with the long axis of said elongated orifice and arranged between said two substantially parallel rows of knitting pegs.

21. The loam of claim 1 further comprising a cross-bridge structure including a central portion flanked by a first lateral portion and a second lateral portion;

wherein the first lateral portion is removably-connected to a first beam of the two beams;

wherein the second lateral portion is removably-connected to a second beam of the two beams; and wherein the central portion includes at least one second peg.

22. The method of claim 17 further comprising providing a cross-bridge structure including a central portion flanked by a first lateral portion and a second lateral portion;

wherein the first lateral portion is removably-connected to a first beam of the two beams;

wherein the second lateral portion is removably-connected to a second beam of the two beams;

wherein the central portion includes at least one second intermediate peg; and wherein the at least one second intermediate peg is aligned with the long axis of said elongated orifice and arranged between said two substantially parallel rows of knitting pegs.

* * * * *